US010932052B2

(12) United States Patent
Hu et al.

(10) Patent No.: US 10,932,052 B2
(45) Date of Patent: Feb. 23, 2021

(54) VOICE COIL, METHOD FOR WINDING VOICE COIL, AND SPEAKER HAVING VOICE COIL

(71) Applicant: AAC Technologies Pte. Ltd., Singapore (SG)

(72) Inventors: Hongjian Hu, Shenzhen (CN); Min Su, Shenzhen (CN); Shuai Li, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 69 days.

(21) Appl. No.: 16/528,634

(22) Filed: Aug. 1, 2019

(65) Prior Publication Data

US 2020/0045454 A1 Feb. 6, 2020

(30) Foreign Application Priority Data

Aug. 4, 2018 (CN) ..... 2018 1 0880970

(51) Int. Cl.
*H04R 7/12* (2006.01)
*H04R 9/02* (2006.01)
(Continued)

(52) U.S. Cl.
CPC ..... *H04R 9/046* (2013.01); *H04R 7/122* (2013.01); *H04R 9/025* (2013.01); *H04R 9/06* (2013.01); *H04R 2400/11* (2013.01)

(58) Field of Classification Search
CPC ..... H04R 9/046; H04R 7/122; H04R 9/025; H04R 9/06; H04R 2400/11; H04R 2209/041
See application file for complete search history.

(56) References Cited

U.S. PATENT DOCUMENTS 7,626,478 B2 * 12/2009 Kawai ..... H01F 27/2847 335/299
7,729,503 B2 * 6/2010 Young ..... H04R 9/022 381/407

(Continued)

FOREIGN PATENT DOCUMENTS

CN 102779627 A1 11/2012
CN 206524953 B1 9/2017
DE 202009001658 A1 4/2009

OTHER PUBLICATIONS

1st Office Action dated Mar. 12, 2020 by SIPO in related Chinese Patent Application No. 201810880970.3 (8 Pages).

*Primary Examiner* — Brian Ensey
(74) *Attorney, Agent, or Firm* — W&G Law Group LLP

(57) ABSTRACT

The present disclosure relates to a voice coil, a method for winding the voice coil, and a speaker having the voice coil. The voice-coil winding is wound from an inner side to an outer side of the voice coil to form an N-layer structure. Each layer is wound to form a multi-coil structure. A winding switching portion is disposed between at least one group of neighboring two layers. Two terminals of the winding switching portion are respectively located at the top and the bottom of the voice coil. One terminal of the winding switching portion is connected to a winding ending terminal of an inner side one of the neighboring two layers, and the other terminal of the winding switching portion is connected to a winding starting terminal of the outer side one of the neighboring two layers.

11 Claims, 3 Drawing Sheets

(51) Int. Cl.
*H04R 9/04* (2006.01)
*H04R 9/06* (2006.01)

(56) References Cited

U.S. PATENT DOCUMENTS 8,638,510 B2 * 1/2014 Lee ..... H02K 5/04
359/824
2007/0183620 A1 * 8/2007 Stiles ..... H04R 9/046
381/401

* cited by examiner

VOICE COIL, METHOD FOR WINDING VOICE COIL, AND SPEAKER HAVING VOICE COIL

TECHNICAL FIELD

The present disclosure relates to acoustic design technology, and in particular, to a voice coil, a method for winding the voice coil, and a speaker having the voice coil.

BACKGROUND

In related technologies, a speaker includes a basket, a vibration system and a magnetic circuit system that are accommodated in the basket. The vibration system includes a voice coil. The voice coil includes a voice-coil input terminal, a voice-coil output terminal, and a voice-coil winding. The voice-coil winding is arranged from an inner side to an outer side of the voice coil to form a multi-layer structure.

However, in related technologies, when the voice-coil winding has a three-layer structure, the voice-coil input terminal and the voice-coil output terminal cannot be ensured to be located at the same side of the voice coil, resulting in that the speaker cannot be applied to SLS (super linear structure) series products.

DETAILED DESCRIPTION

The present disclosure will be described in detail below with reference to FIGS. 1-5.

As shown in FIGS. 1-5, a first aspect of the present disclosure relates to a voice coil 121. The voice coil 121 includes a voice-coil input terminal 121*a*, a voice-coil output terminal 121*b*, and a voice-coil winding 121*c* connecting the voice-coil input terminal 121*a* and the voice-coil output terminal 121*b*. The voice-coil winding 121*c* is wound from an inner side to an outer side of the voice coil 121 to form an N-layer structure. N is an odd number greater than 1, and each layer is wound to form a multi-coil structure. An odd number of winding switching portions 121*d* can be further disposed between at least one group of neighboring two layers. Two terminals of the winding switching portion 121*d* are respectively located at the top and the bottom of the voice coil 121. One terminal of the winding switching portion 121*d* is connected to a winding ending terminal of the inner side one of the neighboring two layers, and the other terminal of the winding switching portion 121*d* is connected to a winding starting terminal of the outer side one of the neighboring two layers, so that the voice-coil input terminal 121*a* and the voice-coil output terminal 121*b* are located at the same side of the voice coil 121.

Figure 3:
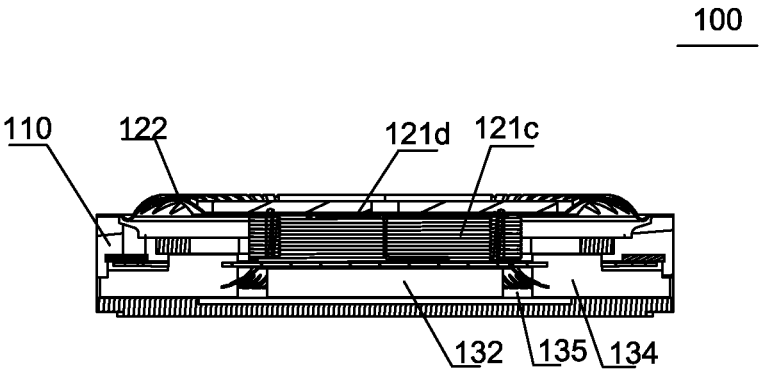
FIG. 3 is another sectional view of a speaker of the present disclosure.
Figure 4:
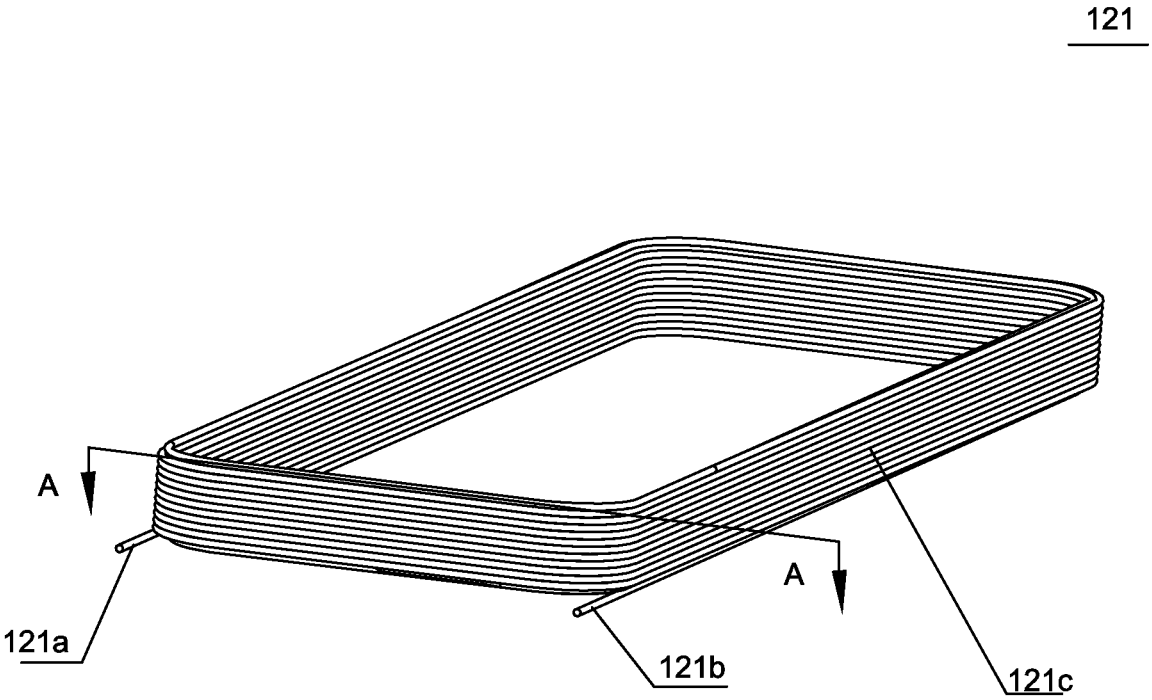
FIG. 4 is a perspective view of a speaker of the present disclosure.
Figure 5:
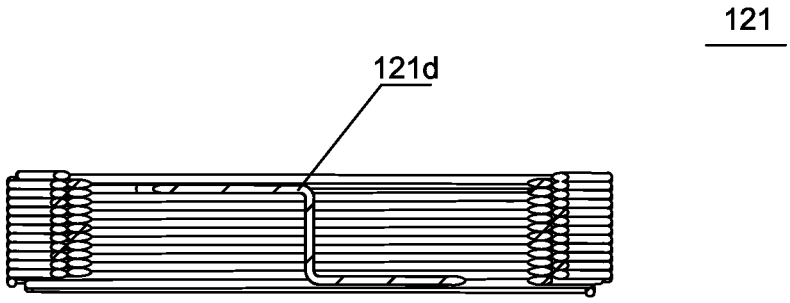
FIG. 5 is a sectional view of a voice coil along an AA direction shown in FIG. 4.

Specifically, as shown in FIG. 3, FIG. 4, and FIG. 5, N can be equal to 3, that is, the voice-coil winding 121*c* is wound from the inner side to the outer side of the voice coil 121 to form a three-layer structure, and each layer is wound to form a multi-coil structure. When a first layer structure is finished being wound, a winding ending terminal of the first layer structure is at the top of the voice coil 121 assuming that a winding starting terminal of a first layer structure is at the bottom of the voice coil 121. Because the two terminals of the winding switching portion 121*d* are respectively located at the top and the bottom of the voice coil 121, and the two terminals of the winding switching portion 121*d* are respectively connected to the winding ending terminal of the first layer structure and a winding starting terminal of a second layer structure, that is, the voice coil is directly pulled from the top to the bottom for subsequent winding when the first layer structure is finished being wound, the voice-coil input terminal 121*a* and the voice-coil output terminal 121*b* are both located at the same side of the voice coil 121, for example, both located at the bottom of the voice coil 121.

It should be noted that, the N above can be any other odd number, and as long as there are an odd number of winding switching portions 121*d* between the first layer structure and the Nth layer structure, the voice-coil input terminal 121*a* and the voice-coil output terminal 121*b* can be ensured to be located at the same side of the voice coil 121. Preferably, only one winding switching portion 121*d* is disposed.

With respect to a speaker 100 in this embodiment, a winding switching portion 121*d* is further disposed between the neighboring two layers. Two terminals of the winding switching portion 121*d* are respectively located at the top and the bottom of the voice coil 121. One terminal of the winding switching portion 121*d* is connected to the winding ending terminal of the inner side one of the neighboring two layers, and the other terminal of the winding switching portion 121*d* is connected to the winding starting terminal of the outer side one of the neighboring two layers, so that the voice-coil input terminal 121*a* and the voice-coil output terminal 121*b* are located at the same side of the voice coil 121. Thus, an application range of the speaker 100 is widened, for example, applied to SLS series products.

A second aspect of the present disclosure provides a speaker 100, as shown in FIGS. 1-5. The speaker 100 includes a basket 110, a vibration system 120 and a magnetic circuit system 130 that are accommodated in the basket 110. The vibration system 120 includes a voice coil 121. The voice coil 121 includes the voice coil 121 described above.

The speaker 100 in this embodiment includes the voice coil 121 described above. A winding switching portion 121*d* is further disposed between neighboring two layers. Two terminals of the winding switching portion 121*d* are respectively located at the top and the bottom of the voice coil 121. One terminal of the winding switching portion 121*d* is connected to the winding ending terminal of an inner side one of the neighboring two layers, and the other terminal of the winding switching portion 121*d* is connected to the winding starting terminal of an outer side one of the neighboring two layers, so that the voice-coil input terminal 121*a* and the voice-coil output terminal 121*b* are located at the same side of the voice coil 121. Thus, an application range of the speaker 100 is widened, for example, applied to SLS series products.

Figure 1:
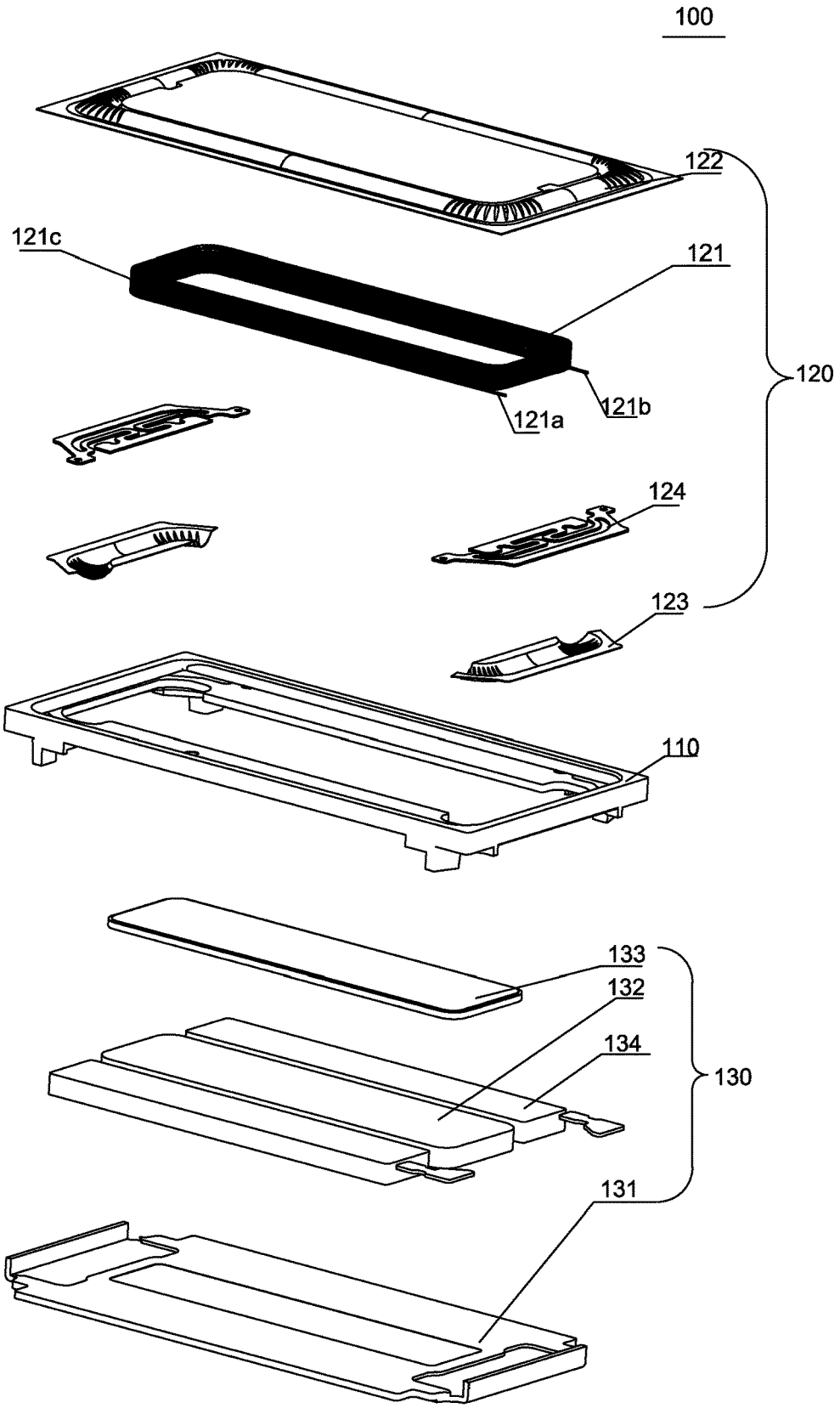
FIG. 1 is an exploded view of a speaker of the present disclosure.
Figure 2:
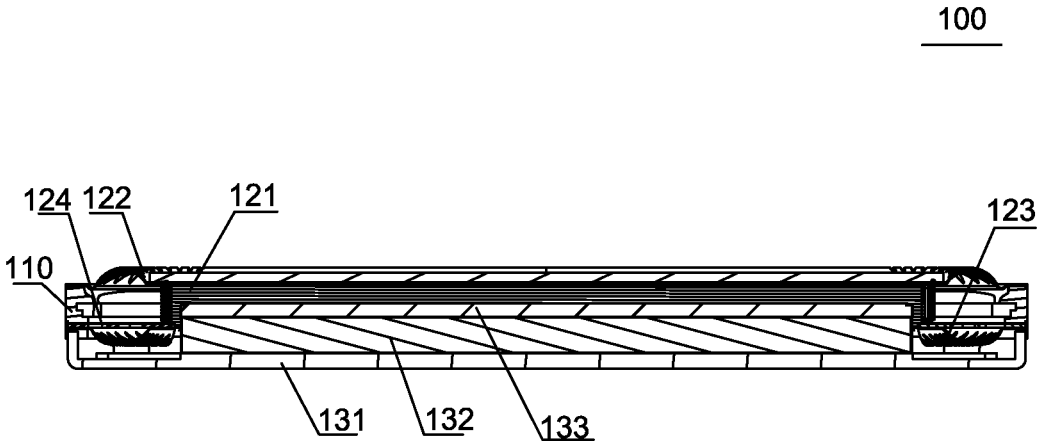
FIG. 2 is a sectional view of a speaker of the present disclosure.

Specifically, as shown in FIG. 1 and FIG. 2, the magnetic circuit system 130 includes a lower clamping plate 131, a main magnetic steel 132 and a pole core 133 that are sequentially arranged on the lower clamping plate 131, and a side magnetic steel 134 disposed opposite to the main magnetic steel 132. A magnetic gap 135 exists between the main magnetic steel 132 and the side magnetic steel 134, and the voice coil 121 is inserted into the magnetic gap 135.

As shown in FIG. 1 and FIG. 2, the vibration system 120 further includes an upper sound membrane 122 and a lower sound membrane 123 respectively at two sides of the voice coil 121, and a flexible circuit board 124 sandwiched between the voice coil 121 and the lower sound membrane 123, and the voice-coil input terminal 121*a* and the voice-coil output terminal 121*b* are both located at one side of the voice coil 121 facing to the lower clamping plate 131. Thus, the speaker 100 having this structure can be applied to SLS series products, thereby widening the application range of the speaker 100.

A third aspect of the present disclosure provides a method for winding a voice coil. A specific structure of the voice coil can refer to the foregoing descriptions, specifically, to FIG. 4 and FIG. 5. The winding method includes the following.

An N-layer structure is formed by sequentially winding from an inner side to an outer side of the voice coil, where N is an odd number greater than 1. Each layer is wound to form a multi-coil structure. And of at least one group of neighboring two layers are as follows.

An inner side one is wound from the bottom of the voice coil to the top of the voice coil to form a multi-coil structure, and the voice-coil winding is directly pulled to the bottom of the voice coil when the layer structure is finished being wound.

An outer side one is wound from the bottom of the voice coil to the top of the voice coil to form a multi-coil structure, so that the voice-coil input terminal and the voice-coil output terminal are located at the same side of the voice coil.

Specifically, for example, when N is 3, a first layer structure is wound from the bottom of the voice coil to the top of the voice coil. When the first layer structure is finished being wound, a winding ending terminal of the voice-coil winding is at the top of the voice coil. At this time, the winding ending terminal of the voice-coil winding can be directly pulled from the top to the bottom of the voice coil to wind a second layer structure. When the second layer structure is finished being wound, a winding ending terminal of the second layer structure is at the top of the voice coil, and a third layer structure is carried out to be wound from the winding ending terminal. When the third layer structure is finished being wound, a winding ending terminal of the third layer structure is at the bottom of the voice coil, so that the voice-coil input terminal and the voice-coil output terminal are both located at the bottom of the voice coil.

With respect to the method for winding the voice coil in this embodiment, when one group of the neighboring two layers is wound, the inner side one is wound from the bottom to the top of the voice coil to form a multi-coil structure. When the inner side one is finished being wound, the voice-coil winding is directly pulled to the bottom of the voice coil for winding a next layer of the voice-coil winding, so that the voice-coil input terminal and the voice-coil output terminal are located at the same side of the voice coil. Thus, an application range of the voice coil is widened, for example, applied to SLS series products.

The above descriptions are merely embodiments of the present disclosure, and it should be noted that those of ordinary skills in the art can make improvements without departing from the creative idea of the present disclosure, and all such improvements shall fall within the protection scope of the present disclosure.

What is claimed is:

1. A voice coil, comprising a voice-coil input terminal, a voice-coil output terminal, and a voice-coil winding connecting the voice-coil input terminal and the voice-coil output terminal, wherein the voice-coil winding is wound from an inner side to an outer side of the voice coil to form an N-layer structure, N is an odd number greater than 1, and each layer is wound to form a multi-coil structure, wherein a winding switching portion is disposed between at least one group of neighboring two layers, two terminals of the winding switching portion are respectively located at the top and the bottom of the voice coil, and one terminal of the winding switching portion is connected to a winding ending terminal of an inner side one of the neighboring two layers, and the other terminal of the winding switching portion is connected to a winding starting terminal of an outer side one of the neighboring two layers, so that the voice-coil input terminal and the voice-coil output terminal are located at the same side of the voice coil.

2. The voice coil according to claim 1, wherein N is equal to 3, and one terminal of the winding switching portion is connected to the winding ending terminal of a first layer structure, and the other terminal of the winding switching portion is connected to the winding starting terminal of a second layer structure.

3. A speaker, comprising a basket, a vibration system and a magnetic circuit system that are accommodated in the basket, wherein the vibration system comprises a voice coil, and the voice coil comprises a voice-coil input terminal, a voice-coil output terminal, and a voice-coil winding connecting the voice-coil input terminal and the voice-coil output terminal, wherein the voice-coil winding is wound from an inner side to an outer side of the voice coil to form an N-layer structure, N is an odd number greater than 1, and each layer is wound to form a multi-coil structure, wherein a winding switching portion is disposed between at least one group of neighboring two layers, two terminals of the winding switching portion are respectively located at the top and the bottom of the voice coil, and one terminal of the winding switching portion is connected to a winding ending terminal of an inner side one of the neighboring two layers, and the other terminal of the winding switching portion is connected to a winding starting terminal of an outer side one of the neighboring two layers, so that the voice-coil input terminal and the voice-coil output terminal are located at the same side of the voice coil.

4. The speaker according to claim 3, wherein N is equal to 3, and one terminal of the winding switching portion is connected to the winding ending terminal of a first layer structure, and the other terminal of the winding switching portion is connected to the winding starting terminal of a second layer structure.

5. The speaker according to claim 3, wherein the magnetic circuit system comprises a lower clamping plate, a main magnetic steel and a pole core that are sequentially arranged on the lower clamping plate, and a side magnetic steel disposed opposite to the main magnetic steel, a magnetic gap exists between the main magnetic steel and the side magnetic steel, and the voice coil is inserted into the magnetic gap.

6. The speaker according to claim 4, wherein the magnetic circuit system comprises a lower clamping plate, a main magnetic steel and a pole core that are sequentially arranged on the lower clamping plate, and a side magnetic steel disposed opposite to the main magnetic steel, a magnetic gap exists between the main magnetic steel and the side magnetic steel, and the voice coil is inserted into the magnetic gap.

7. The speaker according to claim 5, wherein the vibration system further comprises an upper sound membrane and a lower sound membrane respectively located at two sides of the voice coil, and a flexible circuit board sandwiched between the voice coil and the lower sound membrane.

8. The speaker according to claim 6, wherein the vibration system further comprises an upper sound membrane and a lower sound membrane respectively located at two sides of the voice coil, and a flexible circuit board sandwiched between the voice coil and the lower sound membrane.

9. The speaker according to claim 7, wherein the voice-coil input terminal and the voice-coil output terminal are both located at the side of the voice coil facing to the lower clamping plate.

10. The speaker according to claim 8, wherein the voice-coil input terminal and the voice-coil output terminal are both located at the side of the voice coil facing to the lower clamping plate.

11. A method for winding a voice coil, wherein the voice coil comprises a voice-coil input terminal, a voice-coil output terminal, and a voice-coil winding connecting the voice-coil input terminal and the voice-coil output terminal, and the winding method comprises:

forming an N-layer structure by sequentially winding from an inner side to an outer side of the voice coil, wherein N is an odd number greater than 1, and each layer is wound to form a multi-coil structure; and of at least one group of neighboring two layers:

an inner side one is wound from the bottom of the voice coil to the top of the voice coil to form a multi-coil structure, and the voice-coil winding is directly pulled to the bottom of the voice coil when the layer structure is finished being wound;

an outer side one is wound from the bottom of the voice coil to the top of the voice coil to form a multi-coil structure, so that the voice-coil input terminal and the voice-coil output terminal are located at the same side of the voice coil.

* * * * *